US006548432B1

(12) United States Patent
Hisada et al.

(10) Patent No.: US 6,548,432 B1
(45) Date of Patent: Apr. 15, 2003

(54) POLYETHYLENE NONWOVEN FABRIC AND NONWOVEN FABRIC LAMINATE CONTAINING THE SAME

(75) Inventors: Minoru Hisada, Yokkaichi (JP); Shigeyuki Motomura, Yokkaichi (JP)

(73) Assignee: Mitsui Chemicals, Inc., Tokyo (JP)

( * ) Notice: Subject to any disclaimer, the term of this patent is extended or adjusted under 35 U.S.C. 154(b) by 0 days.

(21) Appl. No.: 09/555,599

(22) Filed: May 31, 2000

(30) Foreign Application Priority Data

Oct. 9, 1998 (JP) ..... 10-287751

(51) Int. Cl.[7] ..... D04H 1/00

(52) U.S. Cl. ..... 442/327; 442/361; 442/362; 442/364; 442/382; 442/389; 442/400; 442/401

(58) Field of Search ..... 442/327, 361, 442/362, 364, 382, 389, 400, 401

(56) References Cited

U.S. PATENT DOCUMENTS 5,106,677 A * 4/1992 Yeh et al. ..... 428/220

FOREIGN PATENT DOCUMENTS

JP A63165511 7/1988
JP 63165511 * 7/1988 ..... D01F/6/46
JP A9105060 4/1997
JP 09105060 * 4/1997 ..... D04H/1/56

OTHER PUBLICATIONS

"Textiles" 8th Edition, Kadolph et al, 1998, Prentice–Hall, Inc.*

* cited by examiner

*Primary Examiner*—Terrel Morris
*Assistant Examiner*—Alexis Wachtel
(74) *Attorney, Agent, or Firm*—Birch, Stewart, Kolasch & Birch, LLP

(57) ABSTRACT

A polyethylene nonwoven fabric is produced by the melt-blowing process using a resin composition comprising a polyethylene (A) and a polyethylene wax (B). The fabric is made up with fine fibers having a small fiber diameter and good formation. A nonwoven fabric laminate containing at least one layer comprising the polyethylene nonwoven fabric is excellent in softness, water impermeability and interlaminar bond properties. In particular, the laminate of a meltblown nonwoven fabric comprising the polyethylene nonwoven fabric and a spunbonded nonwoven fabric made up with a conjugate fiber comprising a propylene-based polymer (a) and an ethylene-based polymer (b) provides good uniformity and excellent softness, gas permeability, water impermeability and interlaminar bond strength. The laminate is advantageously used as substrate materials for sanitary goods such as disposable diapers and for packaging materials.

10 Claims, No Drawings

POLYETHYLENE NONWOVEN FABRIC AND NONWOVEN FABRIC LAMINATE CONTAINING THE SAME

This application is the national phase under 35 U.S.C. § 371 of PCT International Application No. PCT/JP99/05558 which has an International filing date of Oct. 8, 1999, which designated the United States of America.

TECHNICAL FIELD

The present invention relates to a polyethylene nonwoven fabric and a laminate comprising the same. More particularly, the present invention relates to a polyethylene nonwoven fabric having a small diameter of fibers making up the nonwoven fabric and good formation as well as to a nonwoven fabric laminate having excellent softness, water impermeability and interlaminar bond properties obtained using the polyethylene nonwoven fabric.

TECHNICAL BACKGROUND

It is known that nonwoven fabrics prepared using polyethylene fibers are soft and comfortable to the touch. However, due to general difficulty in spinning of polyethylene fibers, polyethylene nonwoven fabrics prepared by the conventional meltblowing process have a larger fiber diameter and poor formation. In order to reduce the fiber diameter of polyethylene fibers, it was necessary to elevate a spinning temperature but in this case, gel formation tends to occur sometimes.

It was then attempted to form fibers using a polyethylene of a lower molecular weight than that of a general-purpose polyethylene resin, e.g., a polyethylene wax. However, it was difficult to produce a web continuously, since such a low molecular weight polyethylene had a poor single yarn strength and caused serious fuzzing though its spinnability was good.

Japanese Patent Laid-Open Publication No. 63-165511 discloses a method for preparing polyethylene fibers which comprises blending a linear low density polyethylene having a melt index of less than 40 with a low molecular weight polyethylene having a melt index of 40 or more and one or two members selected from liquid paraffin and then melt-extruding the blend at a particular temperature, thereby to allegedly obtain nonwoven fabrics having a fine fiber in size and soft touch. However, the fiber diameter of the nonwoven fabric produced by the method is at best up to 2 denier (approximately 18 $\mu$m), which is not fine enough.

Therefore, an object of the present invention is to provide a polyethylene nonwoven fabric, which has a very small diameter of fibers and excellent uniformity. Another object of the present invention is to provide a nonwoven fabric laminate having excellent softness, water impermeability and interlaminar bond properties, using the polyethylene nonwoven fabric.

DISCLOSURE OF THE INVENTION

To achieve the foregoing objects, the present invention provides a polyethylene nonwoven fabric produced from a resin composition comprising a polyethylene (A) and a polyethylene wax (B) by the meltblowing process.

To achieve the foregoing objects, the present invention also provides a nonwoven fabric laminate comprising a plurality of nonwoven fabric layers, in which at least one of the nonwoven fabric layers is a layer comprising the above-mentioned polyethylene nonwoven fabric.

BEST EMBODIMENT OF THE INVENTION

The polyethylene nonwoven fabric of the invention (hereinafter referred to as "nonwoven fabric of the invention") and the nonwoven fabric laminate comprising the same will be described below in more detail.

The nonwoven fabric of the invention contains the fibers comprising a resin composition comprising a polyethylene (A) and a polyethylene wax (B).

The polyethylene (A) in accordance with the present invention which is the essential component for forming the fibers to constitute the nonwoven fabric of the invention includes a homopolymer of ethylene and a copolymer of ethylene and other monomer(s). The copolymer may be a random copolymer or a block copolymer. The other monomers include $\alpha$-olefins having 3 to 20 carbon atoms such as propylene, 1-butene, 1-pentene, 1-hexene, 4-metyl-1-pentene, 1-octene, 1-decene, 1-dodecene, 1-tetradecene, 1-hexadecene, 1-octadecene and 1-eicosene. Specific examples of this polyethylene are copolymers of ethylene with $\alpha$-olefins such as 4-methyl-1-pentene and 1-hexene. In the copolymers, the ethylene monomeric unit content is generally at least 80 mol %, preferably in the range of 90 to 99.5 mol % as determined by $^{13}$C-NMR.

As the fibers making up the nonwoven fabric of the invention, these polyethylenes may be employed alone or in combination of two or more.

According to the present invention, the polyethylene (A) has preferably a weight-average molecular weight (Mw) in the range of 21,000 to 45,000, more preferably 23,000 to 40,000, in terms of spinnability and kneading compatibility with the polyethylene wax (B). In the present invention, the weight-average molecular weight (Mw) was determined by gel permeation chromatography under the following conditions.

Apparatus Used

Measurement apparatus: Gel permeation chromatograph (manufactured by Waters Inc., Model 150-C)

Analyzer: System controller (manufactured by Toso Corporation, Model SC-8010)

Detector: Differential refractometer

Conditions for Measurement

Column: TSK gel GMH$_6$-HT×1+TSK gel GMH$_6$-HTL×1 (7.8 mm$^{ID}$×60 mm$^{L}$, manufactured by Toso Corporation)

Moving phase: o-Dichlorobenzene (hereinafter abbreviated as ODCB)

Stabilizer for the moving phase: 2,6-di-tert-butyl-p-cresol (5 g/20 kg-ODCB)

Column temperature: 140° C.

Flow rate: 1.0 ml/min

Feeding volume: 500 $\mu$l

Concentration of a sample measured: 30 mg/20 ml-ODCB

Concentration of the standard sample: 15 mg/20 ml-ODCB

Molecular weight calibration: monodispersed 16 polystyrenes (manufactured by Toso Corporation)

It is preferred that the polyethylene (A) has a density preferably in the range of 0.890 to 0.970 g/cm$^3$, more preferably 0.910 to 0.960 g/cm$^3$, most preferably 0.930 to 0.955 g/cm$^3$. In the present invention, the density of the polyethylene (A) is determined by means of a density gradient tube using a strand, which has been obtained at the time of measurement of a melt flow rate (MFR) at 190° C. under a load of 2.16 kg and which is treated by heating at 120° C. for 1 hour and slowly cooling to room temperature over 1 hour.

The melt flow rate (MFR) of the polyethylene (A), which has been determined in accordance with ASTM D1238 under the conditions of a temperature of 190° C. and a load of 2.16 kg is in the range of generally 15 to 250 g/10 mins., preferably 20 to 200 g/10 mins., more preferably 30 to 200 g/10 mins.

The polyethylene wax (B) which is also the essential component of the fibers making up the nonwoven fabric in accordance with the present invention includes a homopolymer of ethylene and a copolymer of ethylene with other polymerizable monomer(s). As the polymerizable monomers there are the same monomers given as α-olefins for the polyethylene (A). Where a copolymer is used as the polyethylene wax (B), the ethylene monomer unit is contained in the range of generally 80 mol % or more, preferably 90 to 99.5 mol % (as determined by by $^{13}$C-NMR).

The softening point of the polyethylene wax (B) is preferably between 110 and 145° C. In view of spinnability and kneading compatibility with the polyethylene (A), the weight-average molecular weight (Mw) of the polyethylene wax (B) is preferably 15,000 or less, more preferably in the range of 6,000 to 12,000.

The polyethylene wax (B) may be prepared either by polymerization of a low molecular weight polymer conventionally used or by reducing the molecular weight of a high molecular weight polyethylene through thermal degradation. There is no particular restriction how to prepare the polyethylene wax (B).

In the resin composition which forms the fibers making up the polyethylene nonwoven fabric of the invention, a weight ratio of the polyethylene (A) to the polyethylene wax (B), namely, (A)/(B) is preferably in the range of 90/10 to 10/90, more preferably 30/70 to 70/30, most preferably 40/60 to 60/40.

The melt flow rate (MFR) of the resin composition above, which has been determined in accordance with ASTM D1238 under the conditions of a temperature of 190° C. and a load of 2.16 kg is in the range of preferably 300 to 600 g/10 mins., more preferably 400 to 550 g/10 mins.

The resin composition of the present invention may further contain, if necessary and desired, optional components such as other polymers, coloring agents, stabilizers, nucleating agents, etc., so long as the purpose of the invention is not impaired. These optional components include various stabilizers such as known heat stabilizers or weatherproof stabilizers, antistatic agents, slip agents, anti-blocking agents, anti-fogging agents, lubricants, dyes, pigments, natural oil, synthetic oil, etc.

Examples of the stabilizers are anti-aging agents such as 2,6-di-t-butyl-4-methylphenol (BHT), etc.; phenol-based antioxidants such as tetrakis[methylene-3-(3,5-di-t-butyl-4-hydoxyphenyl)propionate]methane, β-(3,5-di-t-butyl-4-hydroxyphenyl) propionic acid alkyl esters, 2,2'-oxamidobis [ethyl-3-(3,5-di-t-butyl-4-hydroxyphenyl). propionate, Irganox 1010 (trademark, hindered phenol type antioxidant), etc.; fatty acid metal salts such as zinc stearate, calcium stearate, calcium 1,2-hydroxystearate, etc.; polyvalent alcohol fatty acid esters such as glycerine monosterate, glycerine distearate, pentaerythritol monostearate, pentaerythritol distearate, pentaerythritol tristearate, etc. These stabilizers may also be used in combination.

The resin composition may further contain fillers such as silica, diatomaceous earth, alumina, titanium oxide, magnesium oxide, pumice powders, pumice balloon, aluminum hydroxide, magnesium hydroxide, basic magnesium carbonate, dolomite, calcium sulfate, potassium titanate, barium sulfate, calcium sulfite, talc, clay, mica, asbestos, calcium silicate, montmorillonite, bentonite, graphite, aluminum powders, molybdenum sulfide, etc.

The polyethylene (A) and the polyethylene wax (B) can be blended with these optional components optionally used depending upon necessity, by means of known techniques.

The nonwoven fabric of the invention can be produced by the meltblowing process which comprises melting and kneading a resin composition comprising the polyethylene (A), polyethylene wax (B) and other optional components, with a extruding machine; extruding the molten composition through a spinneret with spinning nozzles and simultaneously blowing the fiber with a air jet flow of high velocity and high temperature from the periphery of the nozzle to form a web deposit on a collection device in a predetermined thickness as a self-adhesive fine fiber. If necessary and desired, the formed web is then subjected to an entangling processing.

Examples of the entangling processing include a method in which the resulting fibers are bonded by heat embossing using embossing press rolls, a method in which the fibers are bonded by supersonic waves, a method in which the fibers are entangled using a water jet, a method in which the fibers are bonded by passing hot air through the fibers, and a method in which the fibers are entangled with a needle punching. These methods are appropriately chosen and employed to entangle the fibers obtained.

The fineness of the fiber to make up the nonwoven fabric of the invention is preferably not greater than 5 μm in view of uniformity of the nonwoven fabric, more preferably 3 μm or less because a better water impermeability can be obtained.

The present invention further provides a nonwoven fabric laminate comprising a plurality of nonwoven fabric layers, at least one of which is a nonwoven fabric layer comprising the polyethylene nonwoven fabric described above.

In the nonwoven fabric laminate, at least one of the nonwoven fabric layers is made up with the polyethylene nonwoven fabric having the resin composition comprising the polyethylene (A) and the polyethylene wax (B), in order to impart softness, water impermeability (a property showing high water pressure resistance), uniformity and cloth-like appearance and hand to the laminate. The nonwoven fabric laminate of such a multilayered structure may have other additional nonwoven fabrics or films, in addition to the polyethylene nonwoven fabric. The other nonwoven fabrics may be those obtained other than those produced by the meltblowing process, e.g., a dry-spun nonwoven fabric, wet-spun nonwoven fabric or a spunbonded nonwoven fabric. The nonwoven fabric laminate can be a laminate of the polyethylene nonwoven fabric and a film.

Referring to the layer configuration, preferred is such a layer structure comprising at least one spunbonded nonwoven fabric layer and at least one meltblown nonwoven fabric layer, one surface or both surfaces of which are a spunbonded nonwoven fabric layer, because the laminate thus constructed gives excellent wear resistance and resistance to fuzzing.

As the resin which forms the spunbonded nonwoven fabric used in the nonwoven fabric laminate of the present invention, there are polyolef in compositions comprising an ethylene-based polymer such as polyethylene, a propylene-based polymer such as polypropylene, a polyolef in composition containing at least an ethylene-based polymer, etc., from an aspect of adhesion to the polyethylene nonwoven fabric.

Of these resins, particularly preferred examples of the spunbonded nonwoven fabrics include a spunbonded nonwoven fabric made up of an ethylene-based polymer and a spunbonded nonwoven fabric made up of a conjugate fiber which comprises (a) a propylene-based polymer and (b) an ethylene-based polymer and in which the weight ratio of (a) to (b) [(a)/(b)] is in the range of preferably 5/95 to 70/30, more preferably 5/95 to 50/50, much more preferably 10/90 to 40/60, most preferably 10/90 to 20/80 and (b) forms at least a part of the fiber surface. Where the ratio of the propylene-based polymer (a) to the ethylene-based polymer (b) in the conjugate fiber is within the preferred range above, the strength and softness of the nonwoven fabric is well balanced.

Preferred examples of the conjugate fibers include (1) a concentric core-sheath type conjugate fiber made up with the core part comprising the propylene-based polymer (a) and the sheath part comprising the ethylene-based polymer (b); (2) an eccentric core-sheath type conjugate fiber made up with the core part comprising the propylene-based polymer (a) and the sheath part comprising the ethylene-based polymer (b); and (3) a side-by-side type conjugate fiber made up with the propylene-based polymer (a) and ethylene-based polymer (b). Of these conjugate fibers, (2) the eccentric core-sheath type conjugate fiber and (3) the side-by-side type conjugate fiber become crimped and hence, are more preferred in terms of softness.

As the propylene-based polymer (a) which makes up the conjugate fibers, preferred are a propylene hompolymer and a propylene-ethylene random copolymer, having the ethylene monomeric unit content of 0 to 5 mol %. It is desired from a viewpoint of spinnability that the propylene-based polymer (a) used in the conjugate fibers has the melt flow rate (MFR: as 5 determined under a load of 2.16 kg at 230° C. in accordance with ASTM D1238) in the range of preferably 20 to 100 g/10 minutes, more preferably 30 to 70 g/10 minutes. Furthermore, the Mw/Mn (Mw: weight-average molecular weight; Mn: number-average molecular weight, determined as in the Mw measurement described above) is preferably in the range of 2 to 4 from the viewpoint of spinnability. The term spinnability as used herein means the property that the resin can be spun stably without involving breakage of the filament when the nonwoven fabric is prepared by spinning the melted resin through a spinneret according to the spunbonding process.

Examples of the ethylene-based polymer (b) forming the conjugate fiber include an ethylene hompolymer (manufactured either by the low-pressure process or by the high-pressure process) and a random copolymer of ethylene and an $\alpha$-olefin such as propylene, 1-butene, 1-hexene, 4-methyl-1-pentene and 1-octene. It is preferred from the viewpoint of spinnability that these ethylene-based polymers (b) have a density in the range of 0.87 to 0.98 g/cm$^3$, preferably 0.880 to 0.970 g/cm$^3$, more preferably 0.900 to 0.950 g/cm$^3$. Further in view of spinnability, the MFR (as determined under a load of 2.16 kg at 190° C. in accordance with ADTM D1238) is preferably in the range of 20 to 60 g/10 minutes and the Mw/Mn is preferably in the range of 1.5 to 4, more preferably 2 to 4. As the ethylene-based polymer (b), an ethylene homopolymer whose density, MFR and Mw/Mn are within the ranges described above is preferred from the viewpoint of the spinnability and softness of the spunbonded nonwoven fabric obtained using such an ethylene homopolymer.

The nonwoven fabric comprising the conjugate fiber described above is excellent in softness as compared to conventional polypropylene-made nonwoven fabrics, because most or all of the conjugate fiber surfaces forming the nonwoven fabric is made up of the ethylene-based polymer (b). Further when the conjugate fiber making up the nonwoven fabric is a crimped fiber, the softness is more improved.

According to the present invention, the ethylene-based polymer (b) may further contain a slip agent such as oleic amide, erucic amide and stearic amide in a ratio of 0.1 to 0.5 wt %. When the slip agent is added to the ethylene-based polymer, the resulting spunbonded nonwoven fabric shows an excellent resistance to fuzzing. In the present invention, the slip agent may also be added to the propylene-based polymer (a).

Further in the present invention, other polymers, coloring agents, heat stabilizers, nucleating agents, etc. may be added, if necessary and desired, to the propylene-based polymer (a) and/or the ethylene-based polymer (b) to the extent that the purpose of the invention is not impaired.

The spunbonded nonwoven fabric comprising the conjugate fiber can be produced by known methods. For example, after the weight ratio of the propylene-based polymer (a) to the ethylene-based polymer (b) is set to meet the range of 5/95 to 70/30, filaments of the conjugate fiber are spun by the two-extruder melting and spinning method which comprises melting each resin with an extruder and discharging each molten resin through a spinneret with spinning nozzles designed to form a desired composite structure. The filaments thus spun are cooled with a cooling fluid and the filaments are then given tension by means of stretching air to achieve a desired fineness. Thereafter the spun filaments are collected on a collection belt until the filaments are allowed to deposit in a predetermined thickness. The collected filaments are then subjected to the processing of tangling to produce the spunbonded nonwoven fabric. The tangling is processed by similar methods as applied to the meltblown nonwoven fabric. Of these methods, the heat embossing processing is preferably applied to the filaments. In the case of applying the heat embossing process, the embossing area percentage may appropriately be determined but preferably is in the range of 5 to 30%.

The diameter of the fiber that makes up this spunbonded nonwoven fabric is generally about 5 $\mu$m to about 30 $\mu$m (approximately 0.2 to 7 deniers), preferably approximately 10 to 20 $\mu$m.

The use of the spunbonded nonwoven fabric described above provides excellent bond strength when the meltblown nonwoven fabric is bonded to the spunbonded nonwoven fabric by heat embossing.

The nonwoven fabric laminate in accordance with the present invention preferably comprises at least one spunbonded nonwoven fabric layer and at least one meltblown nonwoven fabric layer. The layer configuration is not particularly limited so long as at least one of the surface layers is made up with a spunbonded nonwoven fabric layer. However, the laminate preferably takes a layer configuration of a spunbonded nonwoven fabric layer/a meltblown nonwoven fabric layer or, a spunbonded nonwoven fabric layer/a meltblown nonwoven fabric layer/a spunbonded nonwoven fabric layer.

The basis weight of the nonwoven fabric laminate of the present invention may be appropriately chosen depending upon applications of the nonwoven fabric laminate, quality, economics, etc. required for the laminate. In general, the basis weight of the nonwoven fabric laminate is approximately 7 to 50 g/m$^2$, preferably approximately 10 to 30 g/m$^2$.

Any method may be used for manufacturing the nonwoven fabric laminate of the present invention and there is no particular limitation to the method so long as the laminate can be formed into an integral form. Where the laminate is formed using the spunbonded nonwoven fabric and the meltblown nonwoven fabric, any one of the following methods can be applied to produce the laminate: (1) a method which comprises depositing the meltblown fiber formed by the meltblowing process directly onto the spunbonded nonwoven fabric and then thermally bonding the formed meltblown nonwoven fabric to the spunbonded nonwoven fabric; (2) a method which comprises depositing the meltblown fiber formed by the meltblowing process directly onto the spunbonded nonwoven fabric (i) to form the meltblown nonwoven fabric, depositing the spunbonded fiber formed by the spunbonding process directly onto the aforesaid meltblown nonwoven fabric to form the spunbonded nonwoven fabric (ii), and then thermally bonding the spunbonded nonwoven fabric (i) to the meltblown nonwoven fabric and the spunbonded nonwoven fabric (ii); (3) a method which comprises putting the spunbonded nonwoven fabric and the meltblown nonwoven fabric on top of each other and bonding by heating the two fabrics under pressure; and (4) a method which comprises bonding the spunbonded nonwoven fabric to the meltblown nonwoven fabric using an adhesive such as a hot melt adhesive, a solvent-based adhesive, etc.

The nonwoven fabric laminate of the present invention is excellent in interlaminar bond properties since the meltblown nonwoven fabric is made up with the resin composition comprising the polyethylene (A) and the polyethylene wax (B). Therefore, the nonwoven fabric laminate provides a satisfactory bond strength even when adhered by heat fusion such as a heat embossing processing to the spunbonded nonwoven fabric made up with the conjugate fiber comprising the propylene-based polymer (a) and the ethylene-based polymer (b).

For bonding nonwoven fabrics to each other by heat fusion, there are applicable methods in which the entire contact surfaces of the respective nonwoven fabrics are bonded by heat and in which part of the contact surfaces is bonded by heat. According to the present invention, the method of bonding part of the contact surfaces of the respective nonwoven fabrics by heat is preferably used. In this case, the bonded area (which corresponds to the area impressed by the embossing roll) is preferably 5 to 35%, more preferably 10 to 30%, of the contact surface. Where the bonded area is within the range above, the nonwoven fabric laminate has a well balanced property between bond strength and softness.

Examples of the hot melt adhesive which is employed to bond the spunbonded nonwoven fabric to the meltblown nonwoven fabric with an adhesive include resin-based adhesives such as vinyl acetate and polyvinyl alcohol, and rubber-based adhesives such as styrene-butadiene and styrene-isoprene. Examples of the solvent-based adhesive used for the same purpose include rubber-based adhesives such as styrene-butadiene, styrene-isoprene and urethane, and organic solvent-based and aqueous emulsion type adhesives which are based on resins such as vinyl acetate and vinyl chloride. Of these adhesives, the rubber-based hot melt adhesives such as styrene-isoprene and styrene-butadiene are preferred in that these adhesives do not impair the characteristic hand of the spunbonded nonwoven fabric.

The nonwoven fabric laminate of the present invention thus obtained has good uniformity and excellent gas permeability, water impermeability and softness. The nonwoven fabric laminate also has excellent wear resistance and resistance to fuzzing, because the surface of one or both side of the laminate is formed of the spunbonded nonwoven fabric.

The soft nonwoven fabric laminate of the present invention has the KOSHI value, that is an index of softness, of not more than 10 in general, preferably not ore than 9.5. The nonwoven fabric laminate of the invention also has the water impermeability of 60 mmAq or more generally, preferably 90 mmAq or more.

The nonwoven fabric and nonwoven fabric laminate of the present invention described above are applied to a wide variety of sanitary goods, household materials, industrial materials and medical materials. Especially because of their excellent softness, gas permeability and water impermeability, the nonwoven fabric laminate of the invention is used advantageously for a base material for sanitary and packaging materials. More specifically, the nonwoven fabric laminate of the invention is suitably used as substrates of disposable diapers, sanitary napkins, poultice materials, etc. and as a material for bed covers, etc., and as compact disc bags, food packaging materials, clothing covers, etc. for packaging use.

EXAMPLES

Hereinafter the present invention will be described more specifically, with reference to EXAMPLES and COMPARATIVE EXAMPLES below, wherein the average fiber diameter of the constituent fibers, water impermeability and KOSHI value of the nonwoven fablic were determined by the following methods.

(1) Average Fiber Diameter

Test specimens were cut out of the nonwoven fabric obtained and observed with a scanning electron microscope by 1000 multiplication. The diameter of 30 filaments constituting the nonwoven fabric was measured to determine an average diameter.

(2) Water Impermeability

The water impermeability of the nonwoven fabric was determined in accordance with Method A (low water pressure method) defined by JIS L1096.

(3) KOSHI Value

The tensile, shear strength, compression, surface friction and bending tests were conducted by use of the KES-FB system available from Kato Tech Co., Ltd. using knit high-sensitivity test conditions. The KOSHI value (as the value decreases, softness improves) was determined by carrying out a calculation following a formula using the results of the tests as parameters under knit underwear (summer) conditions.

EXAMPLE 1

A blend of 50 parts by weight of polyethylene (weight-average molecular weight: 24,000, density: 0.935 g/cm$^3$, MFR: 150 g/10 minutes) and 50 parts by weight of polyethylene wax (weight-average molecular weight: 8,000) was melt spun by extruding a molten resin through a spinneret with 360 nozzles having aperture of 0.4 mm in diameter at 0.7 g/min/aperture according to the meltblowing process, and depositing the resulting microfibers on the collection surface to prepare the polyethylene nonwoven fabric having the basis weight of 15 g/m$^2$.

The polyethylene nonwoven fabric thus obtained was determined with the average diameter of the constituent fibers and the water impermeability. The results are shown in Table 1.

EXAMPLE 2

A polyethylene nonwoven fabric having the basis weight of 15 g/m$^2$ was produced in a manner similar to EXAMPLE 1 except that 60 parts by weight of polyethylene (weight-average molecular weight: 38,000, density: 0.950 g/cm$^3$, MFR: 30 g/10 minutes) and 40 parts by weight of polyethylene wax (weight-average molecular weight: 6,000) were used.

The polyethylene nonwoven fabric thus obtained was determined with the average diameter of the constituent fibers and the water impermeability. The results are shown in Table 1.

COMPARATIVE EXAMPLE 1

A polyethylene nonwoven fabric having the basis weight of 15 g/m$^2$ was produced in a manner similar to EXAMPLE 1 except that only polyethylene (weight-average molecular weight: 24,000, density: 0.935 g/cm$^3$, MFR: 150 g/10 minutes) was used. The fabric thus obtained was determined with the average diameter of the constituent fibers and the water impermeability. The results are shown in Table 1.

COMPARATIVE EXAMPLE 2

It was attempted to produce a nonwoven fabric in a manner similar to Example 1 except for using polyethylene wax (weight-average molecular weight: 8,000) alone. However, it was difficult to prepare a web continuously due to its poor web strength and serious fuzzing.

TABLE 1

| | Ex. 1 | Ex. 2 | Comp. Ex. 1 | Comp. Ex. 2 |
|---|---|---|---|---|
| Weight-average molecular weight | | | | |
| Polyethylene (A) | 24,000 | 38,000 | 24,000 | |
| Polyethylene wax (B) | 8,000 | 6,000 | — | 8,000 |
| (A)/(B) by weight | 50/50 | 60/40 | 100/0 | 0/100 |
| Average fiber diameter ($\mu$m) | 3.5 | 2.8 | 4.2 | 2.5 |
| Water impermeability (mmAq) | 380 | 400 | 250 | — |

EXAMPLES 3 and 4 and COMPARATIVE EXAMPLE 4

In each case, a nonwoven fabric laminate was prepared by extruding polyethylene (manufactured by Mitsui Chemicals, Inc., NEOZEX™ 50302; density: 0.950 g/cm$^3$, MFR: 30 g/10 mins. as determined at 190° C. under a load of 2.16 kg in accordance with ASTM D1238) under spinning conditions of a discharge rate of 0.5 g/min/aperture and a resin temperature of 220° C., cooling and stretching to give filaments having a 3 denier fineness, collecting the filaments, putting the collected spunbonded nonwoven fabric (PE-SB) on both surfaces of each of the polyethylene nonwoven fabrics obtained under the same conditions as in EXAMPLES 1 and 2 and the nonwoven fabric obtained under the same conditions as in COMPARATIVE EXAMPLE 1 to form a 3-layered nonwoven fablic, respectively and then bonding by heat embossing at 100° C. under a linear pressure of 60 kg/cm by means of heat embossing (embossed area percentage: 18%). The nonwoven fabric laminates thus obtained were determined with the basis weights of each layer and the whole laminate, the water impermeability and the KOSHI value. The results are shown in Table 2.

EXAMPLE 5

A concentric core-sheath conjugate fiber having a core ratio of 20 wt % (a weight ratio of the core to the sheath, 20:80) was melt spun by using a propylene-ethylene random copolymer having the propylene content of 96 mol % and the ethylene content of 4 mol %, the density of 0.91 g/cm$^3$ and the MFR of 60 g/10 mins. (as determined at 230° C. under a load of 2.16 kg in accordance with ASTM D1238) as the propylene-based polymer for making up the core part and using as the ethylene-based polymer for making up the sheath part a polyethylene having the density of 0.950 g/cm$^3$ and the MFR of 30 g/10 mins. (as determined at 190° C. under a load of 2.16 kg in accordance with ASTM D1238). The concentric core-sheath type conjugate fiber was deposited onto the collection surface (fineness of the component fiber: 2.5 denier) to produce the spunbonded nonwoven fabric (BC-SB). After a meltblown nonwoven fabric obtained under the same conditions as in EXAMPLE 1 was laminated on the spunbonded nonwoven fabric, the spunbonded nonwoven fabric (BC-SB) above was again laminated thereon, followed by the bonding processing using embossing rolls. The nonwoven fabric laminate thus obtained was determined with the basis weights of each layer and the whole laminate, the water impermeability and the KOSHI value. The results are shown in Table 2.

TABLE 2

| | Ex. 3 | Ex. 4 | Comp. Ex. 3 | Ex. 5 |
|---|---|---|---|---|
| Polyethylene nonwoven fablic(1) Weight-average molecular weight | | | | |
| Polyethylene (A) | 24,000 | 38,000 | 24,000 | 24,000 |
| Polyethylene wax (B) | 8,000 | 6,000 | — | 8,000 |
| (A)/(B) by weight | 50/50 | 60/40 | — | 50/50 |
| Other nonwoven fablic (2) | PE-SB | PE-SB | PE-SB | BC-SB |
| Basis weight of each layer (g/m$^2$) | 7/3/7 | 7/3/7 | 7/3/7 | 7/3/7 |
| Basis weight of nonwoven fablic laminate (g/m$^2$) | 17 | 17 | 17 | 17 |
| Water impermeability (mmAq) | 110 | 100 | 50 | 115 |
| KOSHI value | 8.4 | 8.8 | 8.5 | 9.2 |

INDUSTRIAL APPLICABILITY

The polyethylene nonwoven fabric of the present invention made up with fine fibers having a small diameter has good formation and hence, is advantageously used for materials to provide sanitary and household goods. The nonwoven fabric laminate of the present invention provides excellent softness, gas permeability and water impermeability as well as excellent interlaminar bond strength between layers. Based on these excellent properties, the nonwoven fabric laminate of the invention can be suitably used for a wide variety of applications to which nonwoven fabrics have been conventionally used, especially as substrate materials of disposable diapers, sanitary napkins, poultice materials, etc. and as a material for packaging materials.

What is claimed is:

1. A meltblown polyethylene nonwoven fabric wherein polyethylene fibers of said fabric have a diameter of 5 $\mu$m or less and are made from a resin composition consisting essentially of (A) a polyethylene having a weight average molecular weight in the range of 21,000 to 45,000 and a melt flow rate at 190° C., under a load of 2.16 kilograms, in the range of 15 to 250 grams per 10 minutes and (B) a polyethylene wax having a weight average molecular weight of not more than 15,000, wherein the weight ratio of (A)/(B) ranges from 10/90 to 90/10.

2. The meltblown polyethylene nonwoven fabric according to claim 1, wherein said resin composition has a melt flow rate at 190° C., under a load of 2.16 kilograms, in the range of 300 to 600 grams per 10 minutes.

3. The meltblown polyethylene nonwoven fabric according to claim 1, wherein a weight average molecular weight of said polyethylene wax (B) is in the range of 6000 to 12,000.

4. The meltblown polyethylene, nonwoven fabric according to claim 1, wherein said resin composition polyethylene (A) and polyethylene wax (B) in a ratio of 30/70 to 70/30 by weight of (A)/(B).

5. A nonwoven fabric laminate comprising a plurality of nonwoven fabric layers, at least one layer being a layer comprising a meltblown polyethylene nonwoven fabric according to any one of claims 1, 2, 3, or 4.

6. A nonwoven fabric laminate comprising at least one spunbonded nonwoven fabric layer and at least one meltblown nonwoven fabric layer, wherein said meltblown nonwoven fabric is a meltblown polyethylene nonwoven fabric according to claim 1 and wherein at least one surface of said nonwoven fabric laminate is constituted by a spunbonded nonwoven fabric layer.

7. The nonwoven fabric laminate according to claim 6, wherein said spunbonded nonwoven fabric is made up of a conjugate fiber comprising a propylene-based polymer (a) and an ethylene-based polymer (b) which forms at least a part of the fiber surface, and a weight ratio of (a) to (b) is in the range of 5/95 to 70/30.

8. The nonwoven fabric laminate according to claim 7, wherein said conjugate fiber constituting the spunbonded nonwoven fabric is a concentric or eccentric core-sheath type conjugate fiber made up with the core part comprising the propylene-based polymer (a) and the sheath part comprising the ethylene-based polymer (b) or is a side-by-side type conjugate fiber made up with the propylene-based polymer (a) and the ethylene-based polymer (b).

9. The nonwoven fabric laminate according to any one of claims 6, 7, or 8, wherein the KOSHI value is not greater than 10.

10. The nonwoven fabric laminate according to any one of claims 6, 7, or 8, wherein the water impermeability is not smaller than 60 mmAq.

* * * * *